United States Patent [19]

Swingley, Jr.

[11] Patent Number: 4,529,092

[45] Date of Patent: Jul. 16, 1985

[54] CONTAINER WITH SLING DIVIDER

[75] Inventor: Harold E. Swingley, Jr., Monona, Wis.

[73] Assignee: Menasha Corporation, Neenah, Wis.

[21] Appl. No.: 572,012

[22] Filed: Jan. 19, 1984

[51] Int. Cl.[3] ..... B65D 81/10; B65D 85/48; B65D 21/04

[52] U.S. Cl. ..... 206/593; 312/184; 206/425; 206/519; 206/583; 206/517

[58] Field of Search ..... 206/593, 583, 425, 519, 206/515, 517; 312/184

[56] References Cited

U.S. PATENT DOCUMENTS

| | | | |
|---|---|---|---|
| 1,192,859 | 8/1916 | Canfield | 221/25 |
| 2,564,673 | 8/1951 | Chavrin | 312/184 |
| 2,626,610 | 1/1953 | McTavish et al. | 211/162 |
| 2,678,651 | 5/1954 | de Whalley | 312/184 |
| 2,738,914 | 3/1956 | Hatch | 229/2.5 R |
| 2,768,667 | 10/1956 | Hill | 150/35 |
| 2,962,335 | 11/1960 | Benson | 312/184 |
| 2,964,195 | 12/1960 | Valis | 211/11 |
| 3,104,044 | 9/1963 | Reifers | 229/2.5 R |
| 3,798,810 | 3/1974 | Brisson et al. | 40/375 |
| 3,847,459 | 11/1974 | Hegedus et al. | 312/184 |
| 4,049,127 | 9/1977 | Alexander | 211/189 |
| 4,219,247 | 8/1980 | Litchfield et al. | 312/184 |

FOREIGN PATENT DOCUMENTS

| | | | |
|---|---|---|---|
| 819682 | 11/1951 | Fed. Rep. of Germany | 312/184 |
| 1183871 | 7/1959 | France | 312/184 |
| 177091 | 3/1922 | United Kingdom | 312/184 |
| 528053 | 10/1940 | United Kingdom | 312/184 |

OTHER PUBLICATIONS

"Jensen 1983–1984 Catalog" by Jensen Tools Inc., 7815 South 46th Street, Phoenix, Arizona, 85040, p. 42, publication date unknown.

*Primary Examiner*—William Price
*Assistant Examiner*—Brenda J. Ehrhardt
*Attorney, Agent, or Firm*—Quarles & Brady

[57] ABSTRACT

A container for door panels or other articles includes a sling divider having transverse support rods equally spaced along a flexible web. The ends of the rods are received in vertically staggered pairs of side wall pockets so that web sections form slings of different depths relative to the top of the container and thus allow the laterally projecting portions of the articles to deform the web and overlap to accommodate more articles in a container of given length. In the preferred embodiment, the container is rectangular with longer side and shorter end walls, and is nestable with nesting stops that establish a nesting space between the bottom walls of two nested containers, and the support rods are long enough to extend between the side walls but are shorter than the distance between the end walls so the sling divider can be removed, turned, and stored in the nesting space.

2 Claims, 4 Drawing Figures

FIG. 1
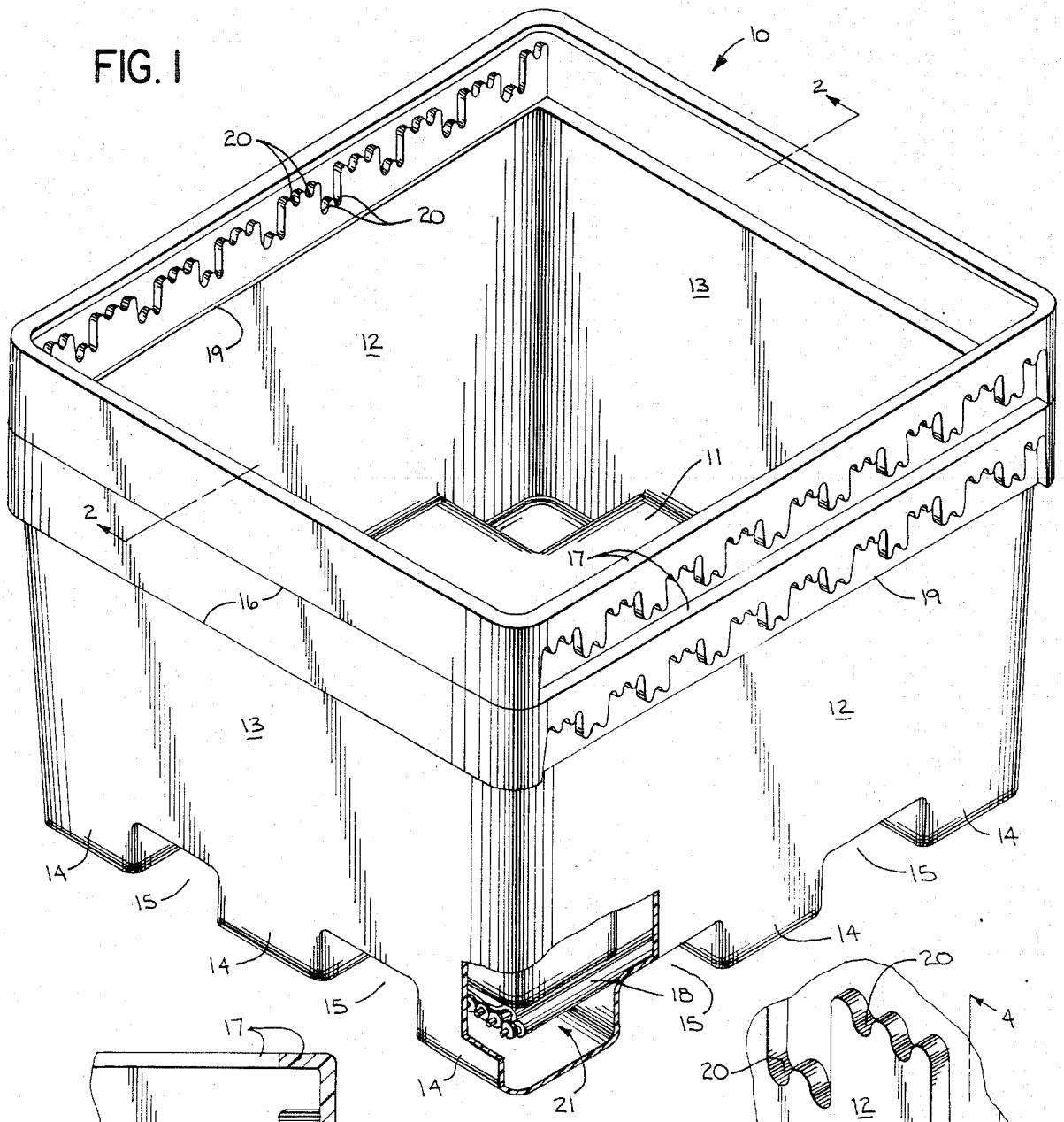
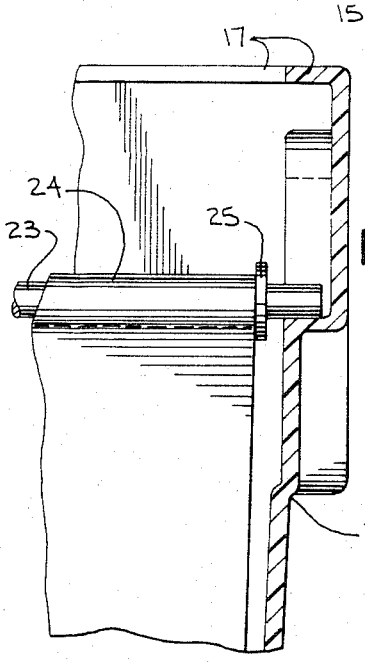
FIG. 4
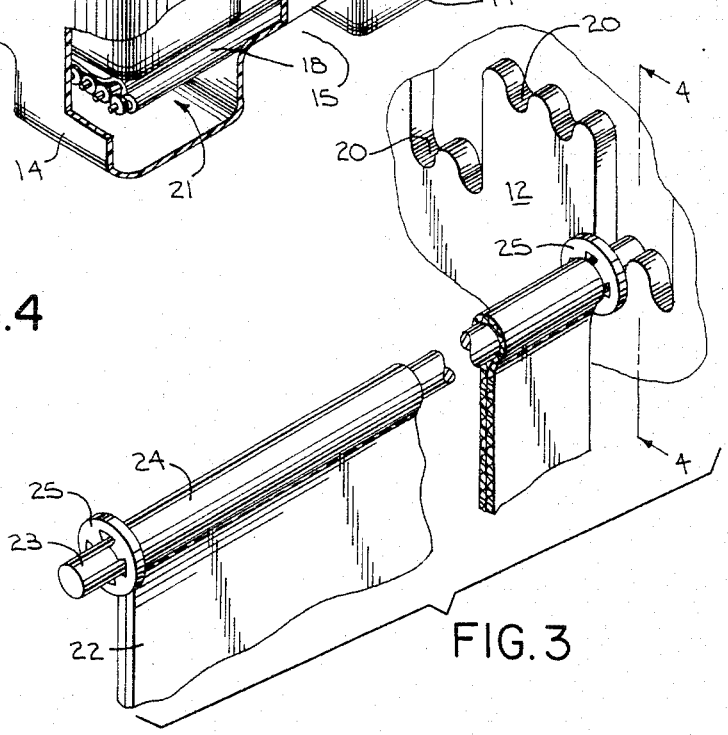
FIG. 3

CONTAINER WITH SLING DIVIDER

BACKGROUND OF THE INVENTION

This invention relates to a preferably nestable container that is provided with a sling divider comprising a flexible web and equally spaced support rods.

Containers sometimes referred to as tote boxes are widely used for carrying and storing production goods. It is often desirable to divide the container into separate compartments for individual items. One divider system that is particularly suitable for easily damaged items, like automobile door panels, is a multiple sling arrangement comprising a flexible web with spaced transverse support rods. The rods are supported in the container and the web material between each adjacent pair of rods hangs down to define a sling to hold an individual item in a cushioned or floating manner. In known arrangements of this type, however, the rods are equally spaced and supported at the same level so that the slings are of equal depth, which presents a space problem when the items being carried have laterally projecting portions. For example, door panels are relatively thin but may have curved upper and/or lower ends which laterally project from the planar part of the panel. If all the panels are supported at the same level, the projecting portions will be next to one another and the width at that point will determine the total number of panels that can be carried in a container of given length.

It is known to overcome problems like this by vertically staggering items so that projecting portions can overlap in a horizontal direction, but known sling arrangements do not lend themselves to this approach. Varying the length of web material between adjacent rods would vary the sling depth, but would be difficult and expensive. Assuming equal lengths, a conventional one-up/one-down staggered arrangement for the support rods would still result in slings of the same depth.

Another problem arises because of the desirability of making containers nestable to save space when they are stored or returned empty. To provide for nesting of containers of the type here contemplated, it is necessary to provide for removal and storage of the sling arrangement in such a way that the sling arrangement does not become separated from the container during return shipment or storage of nested containers.

SUMMARY OF THE INVENTION

This invention contemplates a multi-sling container having a sling divider comprising a web of flexible material with a plurality of equally spaced support rods supported by transversely aligned pockets in the side walls of the container. The pockets are arranged in vertically staggered pairs so that adjacent web sections form slings of different depths relative to the top of the container. Differing depths of adjacent slings and the flexibility of the web forming the slings allow laterally projecting portions of the articles supported in the slings to horizontally overlap so that more articles can be carried in a container of given length.

A further aspect of the preferred embodiment is that the container is substantially rectangular with end walls shorter than the side walls, the end walls and side walls angling outwardly from bottom to top so that the container can nest with a like container. Nesting stops provide a nesting space between the bottom walls of two nested containers, and the support rods of the divider are long enough so that they extend between the side walls but short enough so they can be turned and stored in the nesting space.

It is a principal object of the invention to provide a container which conserves space in the carrying and storage of articles having laterally projecting portions.

It is another object of the invention to provide a nestable container in which a sling divider can be stored in the space between two nested containers.

The foregoing and other objects and advantages of the invention will appear in the following detailed description. In the description, reference is made to the accompanying drawings which show, by way of illustration and not limitation, a preferred embodiment of the invention.

BRIEF DESCRIPTION OF THE DRAWINGS

FIG. 1 is a perspective view, partially broken away, of two nested containers of the invention and showing a sling divider stored in a nesting space;

FIG. 3 is an enlarged fragmentary perspective view of a sling divider support rod and side wall pockets; and FIG. 4 is a view in cross-section as viewed through the plane 4—4 of FIG. 3.

DETAILED DESCRIPTION OF THE PREFERRED EMBODIMENT

Figure 2:
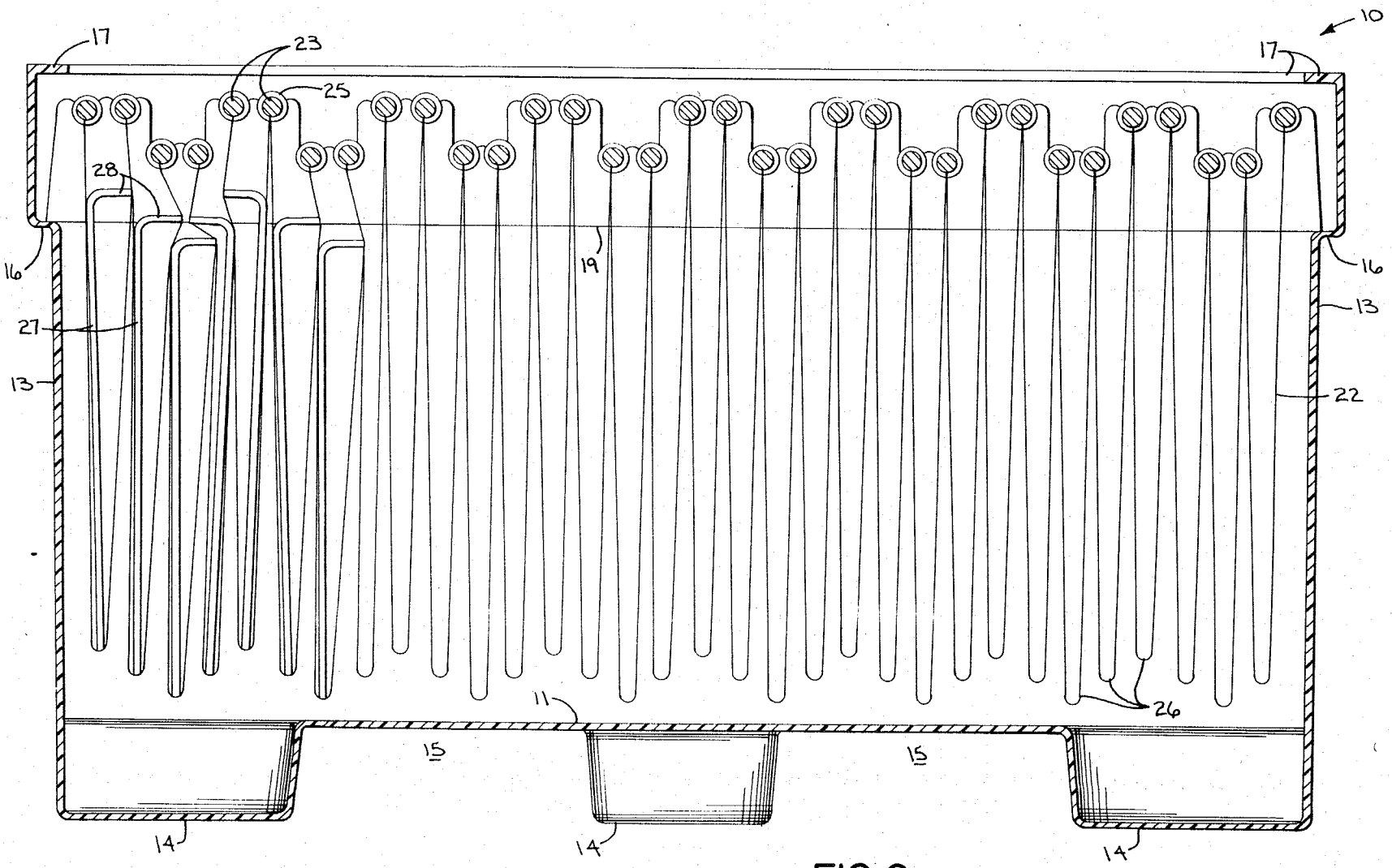
FIG. 2 is a somewhat enlarged view in cross-section as viewed through the plane 2—2 of FIG. 1, but showing only one container, with the sling divider in place and partially loaded with articles having laterally projecting upper portions.

The container shown in the drawings is of conventional overall configuration and is designated generally by the reference numeral 10. It has a bottom wall 11, relatively longer opposing side walls 12, relatively shorter opposing end walls 13, and an open top. It may be molded as a single piece from any suitable plastic material known to those skilled in the art.

The bottom wall 11 and the lower ends of the side and end walls 12 and 13 are shaped to define eight pedestals 14 located, one each, at the corners of the container, at the centers of the side walls 12, and at the centers of the end walls 13. The open spaces between the pedestals 14 define fork channels 15 which extend unobstructed across the bottom 11 to allow handling of the container 10 with a forklift truck.

The lower, major, portions of the side and end walls 12 and 13 angle outwardly from bottom to top so that the container 10 can nest with a like container. The upper portions of the end walls 13 are outwardly offset from the lower portions to define downwardly facing nesting stops in the form of shoulders 16 on the outsides of the end walls 13. Top edge flanges 17 extend horizontally inwardly from the side and end walls 12 and 13 and are continuous around the periphery of the container 10 to add strength to the container and to support the nesting stops 16 of a container nested above. The top flanges 17 and the nesting stops 16 are positioned relative to each other and relative to the bottom wall 11 to provide a nesting space 18 between the bottom walls of the pedestals 14 of the upper container and the bottom wall 11 of the lower container.

The upper portions of the side walls 12 are slightly outwardly offset from the lower portions at 19, largely because of molding considerations. A major outward offset in the upper portions of the side walls 12 above the offsets 19 forms a continuous undulating but generally horizontal ledge that defines vertically staggered pairs of upwardly opening pockets 20 on the insides of the side walls 12. Each pair of pockets 20 is transversely aligned with a corresponding pair of pockets 20 in the opposing side wall.

The pockets 20 are open at the top and are sized to removably receive and support a sling divider generally referred to as 21. The sling divider 21 includes a continuous elongated web of flexible material 22, such as fabric, and rigid support rods 23 equally spaced along the web 22. As best shown in FIG. 3, the rods 23 extend through and longitudinally beyond the ends of sleeves 24 in the web 22. A sleeve 24 is made by bending the web 22 back on itself and sewing it to itself along a line spaced from and parallel to the bend line. The rods 23 fit freely in the sleeves 24 and are restrained from sliding out of the sleeves by push-on spring washers 25 applied to their longitudinally extending ends. The ends of the rods 23 beyond the washers 25 are received by the outwardly offset pockets 20 so that the web 22 extends substantially entirely across the distance between the side walls 12 below the pockets 20.

The sling divider 21 is storable in the nesting space 18 so that it does not become separated from the container 10 during return shipment or storage of nested containers. The top flange 17 is high enough so that the rods 23 are easily removable from the pockets 20. The side walls 12 are slightly longer than the end walls 13 and the rods 23 are short enough so they can be turned to be substantially parallel with the side walls 12 and will fit between the end walls 13 in the nesting space 18, which is of sufficient depth to accommodate the sling divider 21.

As best shown in the right-hand portion of FIG. 2, the vertically staggered pairs of pockets 20 and the equal lengths of web material between the rods 23 combine so that the web sections between adjacent rods form slings 26 and each sling is of different depth, relative to the top 17, from any sling adjacent to it (in the preferred embodiment with pairs of pockets 20 at two levels, the slings 26 ascend and descend in depth in sets of three). The advantage of this appears in the left-hand portion of FIG. 2, which shows the first seven slings loaded with articles 27 having laterally projecting upper portions 28. Holding adjacent articles 27 at different levels due to the varying sling depths results in the laterally projecting portions 28 being at different levels so that they deform the flexible web 22 and overlap one another. More articles 27 can thereby be accommodated in a container 10 of given length.

The sling divider 21 is loaded in a serial fashion. For example, starting with the rods 23 of the sling divider 21 resting on the top edges 17 of the side walls 12, the left end rod 23 of the sling divider 21 is turned slinghtly so it can pass the flanges 17 and placed in the left end pocket 20 of each side wall. An article 27 is then placed in the left end sling 26 with its lateral projection 28 facing to the right and the second rod 23 of the sling divider 21 is placed in the pockets 20 adjacent the rod 23 already in place. This procedure is followed for the next two articles 27 as well. The procedure is the same for the fourth and fifth articles 27, except the articles 27 are placed in the slings 26 with their lateral projections 28 facing to the left. This procedure continues, changing the direction which the lateral projections 28 face after every two articles 27 are loaded, until the container is filled (the orientation of the far left article 27 is not critical since it can deform the web 22 to the left).

Though the lateral projections 28 shown take the form of curved portions at the upper ends of the articles 27, the invention also applies to articles having ridges, bulges or any type of projection occurring anywhere along the article. Also, though the preferred embodiment shows only two different levels of pairs of pockets 20 providing slings 26 at three different levels, the invention applies to more than two levels of pockets. For example, if there were three different levels of pairs of pockets 20, the slings 26 would be at five different depths rather than only three. Further, different nesting stop configurations could be used.

While the preferred embodiment of the invention shown and described provides all of the indicated advantages, it will be obvious that the foregoing and other modifications might be made without departure from the spirit of the invention. The invention is not, therefore, intended to be limited by the showing or description herein, or in any other manner, except insofar as may specifically be required.

What is claimed is:

1. In a container/sling divider arrangement including a container having a substantially rectangular bottom wall, side walls and end walls shorter than the side walls, the side and end walls having main lower portions angling outwardly from bottom to top so that the container can nest with a like container, and a sling divider having a web and a plurality of transverse support rods spaced along the web, the improvement wherein: the top portions of the side and end walls are outwardly offset, with the end wall offsets defining nesting stops engageable with the end walls of a like container below to provide a nesting space between the bottom walls of two nested containers, and the side wall offsets include support means to removably support the ends of the support rods; and the rods are shorter than the distance between the end walls so that the sling divider can be removed from the side walls, turned, and stored in the nesting space.

2. A container/sling divider arrangement according to claim 1, in which the rods are equally spaced along the web, and the side wall support means comprise vertically staggered pairs of transversely aligned pockets so that the equal length web sections between adjacent rods are suspended therebetween to form slings, each sling extending to a depth relative to the top of the container that is different from the depth of any adjacent sling.

* * * * *